United States Patent [19]

Owen et al.

[11] Patent Number: 4,561,966

[45] Date of Patent: Dec. 31, 1985

[54] COMBINATION FLUID BED DRY DISTILLATION AND COKING PROCESS FOR OIL/TAR SANDS

[75] Inventors: Hartley Owen, Belle Mead; James H. Haddad, Princeton Jct.; John C. Zahner, Princeton, all of N.J.

[73] Assignee: Mobil Oil Corporation, New York, N.Y.

[21] Appl. No.: 655,272

[22] Filed: Sep. 28, 1984

[51] Int. Cl.[4] ..... C10G 1/00; C10G 9/32

[52] U.S. Cl. ..... 208/11 R; 208/127; 201/44

[58] Field of Search ..... 208/11 R, 127; 201/31, 201/22, 44

[56] References Cited

U.S. PATENT DOCUMENTS

| | | | |
|---|---|---|---|
| 2,700,017 | 1/1955 | Brown | 201/44 X |
| 2,844,525 | 7/1958 | Scott, Jr. et al. | 208/11 R |
| 3,093,571 | 6/1963 | Fish et al. | 208/11 R |
| 3,261,775 | 7/1966 | Blaser | 208/11 R |
| 3,281,349 | 10/1966 | Evans | 208/11 R |
| 3,320,152 | 5/1967 | Nathan et al. | 201/31 |
| 3,565,766 | 2/1971 | Eddinger et al. | 208/127 |
| 3,976,558 | 8/1976 | Hall | 208/11 R |
| 4,064,018 | 12/1977 | Choi | 201/12 |
| 4,082,646 | 4/1978 | Flynn . | |
| 4,094,767 | 6/1978 | Gifford | 208/11 R |
| 4,161,442 | 7/1979 | Audeh et al. . | |
| 4,210,492 | 7/1980 | Roberts | 201/44 X |
| 4,384,947 | 5/1983 | Van Zanten . | |
| 4,404,083 | 9/1983 | Vasalos . | |
| 4,404,086 | 9/1983 | Oltrogge . | |
| 4,415,433 | 11/1983 | Hoekstra . | |

*Primary Examiner*—D. E. Gantz
*Assistant Examiner*—Glenn A. Caldarola
*Attorney, Agent, or Firm*—Alexander J. McKillop; Michael G. Gilman; Charles J. Speciale

[57] ABSTRACT

A process and apparatus for direct coking of tar sands which includes contacting the tar sand with heat transfer particles resulting from combustion of coked sand effluent from the coking process, and transporting the combination up a riser/mixer to a coking vessel whereby separation of oil and hydrocarbon gases from the sand is initiated. The tar sand is introduced into a fluid coking vessel which has at least two coking zones. The first coking zone is substantially at the top of the vessel whereas the second coking zone is immediately below the first coking zone and includes a stream of hot spent sand so that a more severe coking temperature is present in the second coking zone. A product stream of oil and light hydrocarbon gases, recovered from the riser/mixer and coking process, is directed to a separator located above said coking vessel in which the heavy oil is removed and preferably directed to the second coking zone.

11 Claims, 2 Drawing Figures

COMBINATION FLUID BED DRY DISTILLATION AND COKING PROCESS FOR OIL/TAR SANDS

BACKGROUND OF THE INVENTION

The present invention relates to processes for recovery of bitumen tar sands, and, in particular, to a method for direct coking of tar sands without requiring a prior separation of the bitumen.

The rapid escalation in petroleum prices, along with the uncertainties related to the continuous supply of oil, provides motivation for countries to review their inventory of fossil fuels with a view to developing resources of lower quality oil supplies such as oil shales, tar sands, and heavy oils. Generally, such resources are of lower grade than conventional petroleum because they contain a greater proportion of mineral matter, a lower hydrogen content, and a higher proportion of foreign atoms, such as oxygen, nitrogen, and sulphur, which have to be removed to make acceptable fuels for commerce. These factors increase the capital requirements necessary to produce acceptable products, whether it be fuel or petrochemical.

Tar sands, also known as oil sands or bituminous sands, are sand deposits impregnated with a dense, vitreous petroleum-like material generally termed bitumen. Tar sands are found throughout the world and the largest known deposites are in the province of Alberta, Canada and Eastern Venezuela, although deposits in the lower continental United States are also believed to be quite sizeable.

The tar sands are primarily silica, closely associated with petroleum-like material (heavy oily material) which varies from about 5 to about 21% by weight, with a typical content of 13 weight percent comprising the sand. The oil is quite heavy, 6° to 8° API gravity and contains typically 4.5% sulfur and about 38% of aromatics. Tar sands also include clay and silt in quantities of from 1 to 50 weight percent, and water in quantities of 1-10% by weight.

Bitumen can be separated from the sand by a variety of methods, including first in situ thermal, emulsion-steam drive, and even atomic explosion mining; followed by processing of various types such as direct coking, anhydrous solvent extraction, cold water separation, hot water separation, and the like; and any of these followed by possibly various methods of upgrading the separated bitumen to a more salable product generally described as synthetic crude oil.

Despite the fact that the existence of tar sand deposits has been known for years, and that the bitumen can be separated for crude oil production, nevertheless, as a matter of fact, separating the bitumen on a practical, economical basis has met with little success.

A thermal method of recovering bitumen by direct retorting has been studied since 1940. In direct retorting, raw tar sand can be contacted with spent sand and fluidized by reactor off-gas at a temperature around 900° F. The volatile products are flashed off, while coke is deposited via thermal cracking. The coked sand can then be burned off in a separate unit at 1200°-1400° F. and recirculated.

Early work on direct retorting of tar sand is reported by P. E. Gishler and W. S. Peterson in "Oil from Alberta Bituminous Sand" in *Petroleum Engineer,* Vol. 23, Issue 23, pp. c 66-c 76 (1951), and "The Fluidize Solids Technique Applied to Alberta Oil Sands Problem" in *Proceedings of the Alabasca Oil Sands Conference, Edmunton, Alterta,* pp. 207-236 (1951), and by R. W. Ramuler in "The Production of Synthetic Crude Oil from Oil Sand by Application of the Lurgi-Rhurgas Process" in the *Canadian Journal of Chemical Engineering,* Vol. 48, pp. 552-560 (1970). The technology of retorting tar sand in general is known as and is referred to herein as, direct coking.

One of the known processes for direct coking of tar sands is the Lurgi-Rhurgas, which is a dry distillation process wherein mined tar sand is fed into a mixture from a feed bin and is contacted with hot recirculated sand at 1200° F. (The sand is heated in a lift heater by burning off the coke that is deposited on the sand in the mixer.) A final retorting temperature of 900° to 1,000° F. is attained whereby the bitumen is broken down into a liquid, vapor, and entrained solids. The product stream is sent to a cyclone to remove particulate, and then to scrubbers to recover the light gases and product liquids. The hot sand from the mixer drops to a surge hopper where it is divided into two streams, one stream being recirculated to the mixer through the lift heater and the other stream being sent to an air pre-heater. While the overall bitumen recovery in the Lurgi-Rhurgas dry distillation process is estimated at 70%, this system suffers from several disadvantages, including severe heat loss in spent sand, small unit throughput and poor scale-up economics, expensive construction and replication of retorting equipment, and inefficient methods for preparation and handling of tar sand feed.

Another process for direct coking is the Taciuk process which is similar to the Lurgi-Rhurgas process except for the equipment. In the Taciuk process, the bitumen is retorted in a rotating kiln, rather than the mixer and surge hopper of the Lurgi-Rhurgas process. The Taciuk process suffers a disadvantage of having limited scale-up possibilities particularly because of seal problems associated with a large rotating kiln.

It is, therefore, an object of the present invention to overcome problems generally known in the art of direct coking, as set forth above, and in general, to make direct coking a commercially viable process by, inter alia, eliminating the need for hot screw feeds or rotating kilns.

SUMMARY OF THE INVENTION

The process invention is a process and apparatus for upgrading tar sands by direct coking thereof, which includes contacting the tar sand with heat transfer particles at an elevated temperature produced by combustion of coked sands, in a ratio of tar sand to heat transfer particles of from about 1:1.5 to about 1:5.0, at a temperature of at least about 1000° F. in a contact zone located at the lower end of a riser mixer. The combination tar sand and heat transfer particle (spent sand) burden is lifted upwardly in the riser/mixer by a lift gas containing less than a sufficient amount of molecular oxygen to support combustion so that the combination is fluidized, mixed, and separation of oil and light hyrocarbon gases is initiated.

An overhead fluid coking vessel is located at the top of the riser/mixer into which the tar sand/spent sand mixture is introduced, preferably through a grid so that substantially equal distribution of the combination is made throughout the coking vessel. The coking vessel includes at least two coking zones. The first coking zone is located directly above the grid, while the second coking zone is located immediately therebelow. The entire coking vessel is subjected to a pressure of from about 5 to about 20 psig and the first coking zone is maintained at temperatures of from about 825° F. to about 950° F. whereas the second coking zone operates at a temperature of from about 50° F. to about 100° F. higher than the first coking zone. If more than two coking zones or stages are employed, each subsequent zone is maintained at a temperature of at least 50° F. higher than the preceding coking zone.

The present system also includes a separating means, such as a scrubbing and fractionating tower positioned substantially vertically above the fluid coking vessel so that the product oils, naphthas and light hydrocarbon gases can be recovered. Preferably, heavy residual-like oil from which the products are fractionated can be then redirected back to the second coking zone to undergo coking at the more severe coking conditions present therein.

According to the present invention, the second coking zone can be maintained at the higher temperature by means of at least one stream of heat transfer particles resulting from the combustion of coke sands withdrawn from the coking vessel. Withdrawal of the stripped coked sands is made from the bottom of the fluid coking vessel and conveyed to a combustor wherein the coked sand is burned to produce hot spent sand which, in turn, is recirculated to the contact zone for contact with the tar sand and the second coking zone in order to maintain the high temperature required for secondary coking. While it is contemplated that hot spent sand constitutes the primary heat transfer particles, solid catalyst particles can be included in the heat transfer particles.

The lift gas used in the riser mixer can be chosen from the group consisting of steam, air, and light off-gas recovered from the product stream, as well as combinations thereof.

Furthermore, in a preferred embodiment of the present invention, a portion of the hot spent sand resulting from the combustion can be recycled with the coked sand withdrawn from the bottom of the coking vessel as it is directed to the combustor thereby raising the temperature of the coked sand in preparation for combustion. If necessary, additional fuel may be added to the combustor in order to support combustion if the amount of coke delivered with the stripped coked sand is not sufficient for heat balance.

As a result of the present invention, much of the heat required to maintain the extremely high temperatures required for the direct coking process are derived and sustained by use of heat containing or heat producing interim products resulting during the process.

For a better understanding of the present invention, together with other and further objects, reference is made to the following description, taken in conjunction with the accompanying drawings, and its scope will be pointed out in the appended claims.

DETAILED DESCRIPTION OF THE INVENTION

Figure 1:
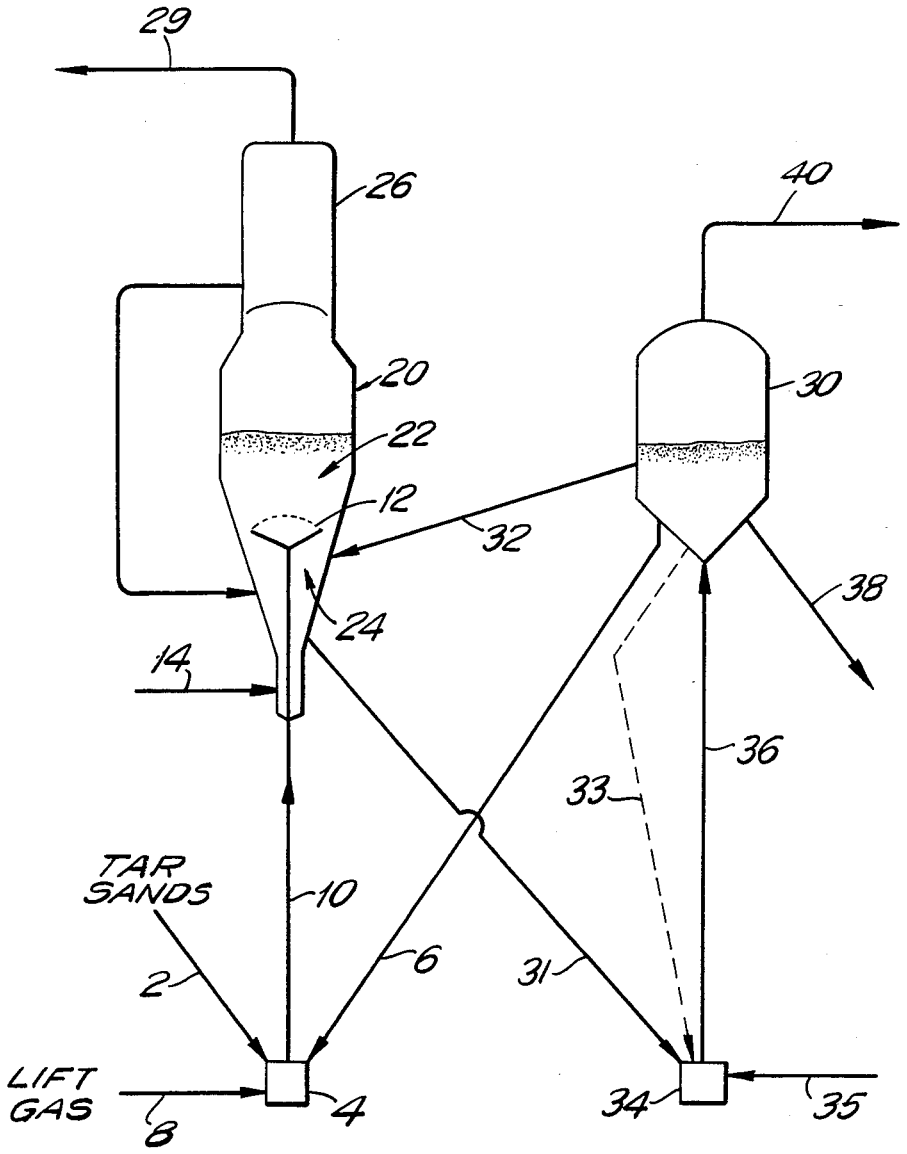
FIG. 1 is a schematic showing the overall direct coking system embodying the present invention including the preferred embodiments thereof.
Figure 2:
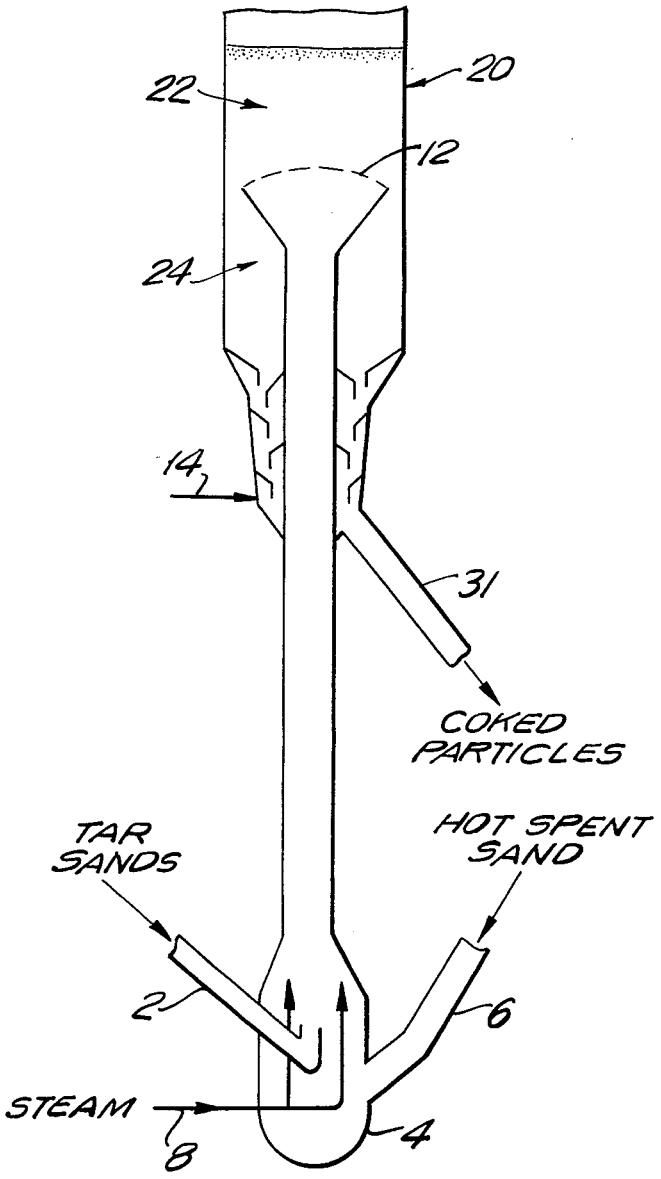
FIG. 2 is a schematic showing an isolated view of the direct coking apparatus without the attendant recycle system which is involved in the present invention.

Referring to the drawing by way of example, tar sands comprising petroleum containing material in the range of about 5 to about 21% by weight and usually less than 15% by weight is charged to the processing combination of the invention by conduit 2, preferably an insulated water cooled pipe and/or pipes which prevents the sands from sticking and plugging up the feed system.

The tar sands are contacted in contact zone 4 which is preferably a riser lift pot, with hot spent sands directed via conduit 6 from burner lift vessel 30.

Lift gas, which is injected into contact zone 4 by means of conduit 8, can include gases which do not support combustion such as steam, lightends product off-gas resulting from the product stream, and/or any other inert gas, or combinations thereof so long as the total amount of molecular oxygen present is insufficient to support combustion. The lift gas transports the combination of tar sands and hot spent sand which upon contact reaches an overall temperature of from about 825° F. to about 1050° F. up riser mixer 10 into the main fluid coking vessel 20. In order to insure distribution of the tar sands and hot spent sand relatively uniformly in the coking vessel 20, the top of riser mixer 10 is preferably provided with a grid 12.

In order to insure good mixing and distillation of the hydrocarbon, the solids density in the transport riser is approximately 1–35 lbs. per cubic foot, and preferably 2–10 lbs. per cubic foot. The transport density is regulated by the amount of lift gas, preferably steam, added to the riser lift pot.

The design and dynamics of the main fluid coking vessel follow generally the principles of fluid coking. However, in the present invention, the fluid coking vessel includes at least two separate coking stages or zones designated generally in FIG. 1 as 22 for zone 1 and 24 for zone 2. The pressure in the fluid coking vessel is from about 5 to about 20 psig while superficial vapor velocities in the main coking vessel range from about 1 to about 3.5 feet per second. The temperature of the main coking vessel is maintained at from about 820° F. to about 950° F. so that the first coking zone 22, provides a coking temperature of about 900° F.

The tar sands having been coked in the first coking zone 22 flow downwardly by gravity flow into the second coking zone 24 wherein the coking conditions are more severe. Specifically, the temperature of the second coking zone 24 is maintained at between about 50° F. to about 100° F. higher than the first zone 22, e.g., to a maximum temperature of about 1050° F. In the present invention, this more severe coking temperature can be provided, primarily, by adding additional hot solids via conduit 32 to the combined overflow of the first stage. Other feed conduits can be provided to introduce additional hot solids streams as required. Steam can be added in the coking section, such as by injection conduit 14, to strip the coked solids, and it is contemplated that this stripping stream in addition to that added to facilitate the transport of the solids will be sufficient for the overall coking operation.

The vapor effluent exits the fluid coker via cyclones (not shown herein), which can also be heated by a small stream of hot solids (also not shown in the figures), and through a separating means such as scrubbing and fractionating equipment 26 normally associated with a fluid coker. The heavy oil resulting from recovery of the stream of oil and light hydrocarbon gases passing through this equipment can, in the one embodiment of the invention, conveniently be recycled to the second coking zone 24 so that the heavy oil can be coked under the more severe coking conditions. Products remaining after separation of the heavy oil can then be conveyed via effluent line 29 to further fractionating equipment.

Coked particles stripped with steam before leaving the main coker are withdrawn from the main coking vessel via line 31 and directed to a combustor lift pot 34 where it is mixed with sufficient oxygen, usually in the form of pre-heated compressed air via line 35, and, in a preferred embodiment, with recirculated hot solids recovered from burner lift vessel 30 through line 33, and burned to provide thermal energy for the combination process of the invention. When the burden withdrawn from the main fluid coking vessel is mixed with recirculated hot solids from line 33, the mixture attains a temperature of about 1100° F. as it is introduced into burner 34. The hot burned sands are transported upwardly in lift burner 36 to thermal burner lift vessel 30 maintained at about 1300° F. where it is distributed to process conduits, inter alia, 6, 32 and 33, as well as net make conduit 38, which can be used to recover heat by pre-heating the compressed air used in the combustion process and by generating steam used in the process. Meanwhile, overhead conduit 40 directs hot flue gases to fines removal area and for further heat recovery. Heat is also recovered in the hydrocarbon fractionation system 26, generally in the form of steam.

Since, in some cases, particularly for lean tar oil sands, the inherent coking yield may be too low to sustain the heat balance, additional fluid coke or grounded up coke from off plant sources can be used to supplement the stripped coke product, rather than overcoking or burning quality fuel.

Additionally, the concept of adding spent and/or discarded FCC catalyst for improving the product quality and/or mechanics of solid circulation is contemplated for use as part of the heat transfer particles in the present invention.

Thus, while there have been described what are presently believed to be the preferred embodiments of the invention, those skilled in the art will realize that changes and modifications may be made thereto without departing from the spirit of the invention, and it is intended to claim all such changes and modifications as fall within the true scope of the invention.

What is claimed is:

1. A process for direct coking tar sands comprising:

contacting tar sand with heat transfer particles heated to a temperature of about 1200° F. obtained as defined below in a ratio of tar sand to heat transfer particles of from about 1 to 1 to about 1 to 5, in a contact zone at the lower end of a riser/mixer, injecting a lift gas containing less than a sufficient amount of molecular oxygen to support combustion into said contact zone to fluidize, mix, and transport said tar sand and said heat transfer particles upwardly through said riser/mixer into an overhead fluid coking vessel positioned substantially vertically above said riser/mixer, introducing the effluent from said riser/mixer into a first coking zone of said fluid coking vessel located substantially above and at the top of said riser/mixer, said first coking zone maintained at a temperature of from about 825° F. to about 950° F., moving said effluent downwardly in said overhead coking vessel into at least a second coking zone located below said first coking zone, feeding at least one stream of heat transfer particles obtained as defined below into at least said second coking zone to maintain the temperature of said second zone at from about 50° F. to about 100° F. higher than the preceding coking zone, recovering a stream of oil and light hydrocarbon gases liberated from said tar sand in said riser/mixer and said fluid coking vessel, withdrawing stripped coked sands and heat transfer particle burden from said fluid coking vessel, conveying said burden to a combustor, and combusting said stripped coked sand to produce said heat transfer particles used to contact said tar sand and to maintain said elevated temperature in said at least second coking zone.

2. The process of claim 1, wherein a stream of stripping gas is introduced into said fluid coking vessel.

3. The process of claim 1, wherein said stream of recovered oil and light hydrocarbon gases is directed to a scrubbing and fractionating tower positioned substantially vertically above said fluid coking vessel wherein heavy oil is separated from said stream.

4. The process of claim 3, wherein said heavy oil is fed into said second coking zone whereby said heavy oil is further coked at the elevated temperature present in said second coking zone.

5. The process of claim 1, wherein said lift gas is selected from the group consisting of steam air, light ends off-gas recovered from said product stream and combinations thereof.

6. The process of claim 1, wherein a portion of said heat transfer particles resulting from said combustion is recycled directly to said combustor with said withdrawn stripped coked sand/heat transfer particle burden thereby raising the temperature of said coked sand for combustion.

7. The process of claim 1, wherein said heat transfer particles further comprises catalyst particulate.

8. The process of claim 1, wherein said effluent and said heat transfer particles are contacted in additional coking zones.

9. The process of claim 1, wherein there are more than one stream of heat transfer particles fed into said at least second coking zone.

10. The process of claim 1, wherein heat is recovered from hot effluent streams selected from the group consisting of net make resulting from said combustor, hot flue gases generated by said conbustor, and said stream liberated from said tar sand in said riser/mixer and said fluid coking vessel.

11. The process of claim 7, wherein said catalyst particulate is selected from the group consisting of spent FCC catalyst and discarded FCC catalyst.

* * * * *